US008650839B1

(12) United States Patent
Robinson et al.

(10) Patent No.: US 8,650,839 B1
(45) Date of Patent: Feb. 18, 2014

(54) CLOSURE WITH LIFTING MECHANISM

(75) Inventors: Clayton L. Robinson, Elberfeld, IN (US); Randall G. Bush, Evansville, IN (US); William J. Shankland, Evansville, IN (US); Kiran M. D'Silva, Evansville, IN (US); Louis John Marsella, Reno, NV (US); Gary V. Montgomery, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 530 days.

(21) Appl. No.: 12/123,067

(22) Filed: May 19, 2008

Related U.S. Application Data

(62) Division of application No. 11/934,600, filed on Nov. 2, 2007, now Pat. No. 8,251,236.

(51) Int. Cl.
*B65B 61/18* (2006.01)

(52) U.S. Cl.
USPC ..... 53/412; 53/416; 53/471; 53/381.4

(58) Field of Classification Search
USPC ..... 53/412, 416, 435, 453, 471, 371.4, 53/381.4, 381.2; 215/252, 271, 276, 230, 215/250
See application file for complete search history.

(56) References Cited

U.S. PATENT DOCUMENTS

| | | | |
|---|---|---|---|
| 946,138 | A | 1/1910 | Kirkegaard |
| 1,127,357 | A | 2/1915 | Gavaza |
| 1,346,112 | A | 7/1920 | Bruns |
| 1,556,020 | A | 10/1925 | Noll |
| 1,715,882 | A | 6/1929 | Wygonik |
| 1,910,913 | A | 5/1933 | Conner |
| 1,916,977 | A | 7/1933 | Gutmann |
| 1,937,492 | A | 11/1933 | Merolle |
| 1,961,033 | A | 5/1934 | Bicks |
| 1,995,350 | A | 3/1935 | Hoag |
| 2,039,757 | A | 5/1936 | Von Till |
| 2,085,934 | A | 7/1937 | Von Till |
| 2,156,258 | A | 5/1939 | Atwood |
| 2,188,946 | A | 2/1940 | Gutmann |
| 2,242,256 | A | 5/1941 | McManus |
| 2,312,513 | A | 3/1943 | Wilson |
| 2,620,939 | A | 12/1952 | Weisgerber |
| 2,643,021 | A | 6/1953 | Freedman |
| 2,670,869 | A | 3/1954 | Martin |
| 2,681,742 | A | 6/1954 | Miller |
| 2,686,606 | A | 8/1954 | Froitzheim |
| 2,686,607 | A | 8/1954 | Zander |
| 2,748,969 | A | 6/1956 | Leary |
| 2,904,837 | A | 9/1959 | Crabbe |

(Continued)

FOREIGN PATENT DOCUMENTS

| | | |
|---|---|---|
| CA | 2572379 | 12/2006 |
| DE | 3237634 | 4/1984 |

(Continued)

*Primary Examiner* — Sameh H. Tawfik
(74) *Attorney, Agent, or Firm* — Barnes & Thornburg LLP

(57) ABSTRACT

A closure having a device for lifting a liner from a container opening. The lifting device being a finger projecting from a hinge connection within the closure. The hinge connection is positioned from a depending skirt of the closure. The hinged finger disengages the liner from a sealing engagement with the container while engaging along substantially the same annulus spaced from the liner edge. A plurality of the hinged fingers may be used for the lifting device. The closure may be used in various retort and aseptic applications, as well as provide for tamper indication.

14 Claims, 12 Drawing Sheets

(56) References Cited

U.S. PATENT DOCUMENTS 2,929,525 A 3/1960 Glover
2,950,833 A 8/1960 Short
3,143,364 A 8/1964 Klein
3,169,656 A 2/1965 Wieckmann
3,186,209 A 6/1965 Friedman
3,189,209 A 6/1965 Owens
3,200,982 A 8/1965 Cormier
3,224,617 A 12/1965 Hohl
3,245,857 A 4/1966 Rutledge
3,255,907 A 6/1966 Eddy
3,266,658 A 8/1966 Meissner
3,269,577 A 8/1966 Stuart
3,331,523 A 7/1967 Exton
3,360,149 A 12/1967 Roth
3,382,997 A 5/1968 Tsuji
3,501,042 A 3/1970 Risch
3,527,372 A 9/1970 Manning
3,530,917 A 9/1970 Donovan
3,547,294 A 12/1970 Williams
3,612,325 A 10/1971 Williams
3,632,004 A 1/1972 Grimes
3,788,510 A 1/1974 Collins
3,815,314 A 6/1974 Pollock et al.
3,823,182 A 7/1974 Eisai
3,845,525 A 11/1974 Gaylord
3,857,506 A 12/1974 Hafele
3,879,492 A 4/1975 Bontinick
3,910,410 A 10/1975 Shaw
3,917,100 A 11/1975 Dukess
3,923,179 A 12/1975 Choksi
3,923,182 A 12/1975 Choksi
3,923,183 A 12/1975 Choksi
3,923,184 A 12/1975 Choksi
3,923,185 A 12/1975 Choksi
3,944,103 A 3/1976 Cros
3,973,719 A 8/1976 Johnson et al.
3,980,194 A 9/1976 Costa
4,007,848 A 2/1977 Snyder
4,009,793 A 3/1977 Minesinger et al.
4,013,188 A 3/1977 Ray
4,066,181 A 1/1978 Robinson et al.
4,076,152 A 2/1978 Mumford
4,091,949 A 5/1978 Fowles et al.
4,093,093 A 6/1978 Fowles et al.
4,109,815 A 8/1978 Collins, III
4,128,184 A 12/1978 Northup
4,151,924 A 5/1979 Jameson
4,181,232 A 1/1980 Bellamy et al.
4,204,604 A 5/1980 Morin et al.
4,207,990 A 6/1980 Weiler et al.
4,209,126 A 6/1980 Elias
4,266,687 A 5/1981 Cummings
4,275,817 A 6/1981 Patton
4,276,989 A 7/1981 Hicks
4,280,653 A 7/1981 Elias
4,358,919 A 11/1982 Hirota et al.
4,364,485 A 12/1982 Knapp
4,369,889 A 1/1983 Ostrowsky
4,378,894 A 4/1983 Willis et al.
4,381,840 A 5/1983 Ostrowsky
4,382,521 A 5/1983 Ostrowsky
4,392,579 A 7/1983 Uhlig et al.
4,423,821 A 1/1984 McIntosh
4,427,126 A 1/1984 Ostrowsky
4,430,288 A 2/1984 Bonis
4,434,904 A 3/1984 D'Amico et al.
4,457,440 A 7/1984 Dukess
4,473,163 A 9/1984 Geiger
4,493,427 A 1/1985 Wolkonsky
4,496,674 A 1/1985 Ehrhart et al.
4,501,371 A 2/1985 Smalley
4,523,689 A 6/1985 Laub
4,526,279 A 7/1985 Weiler et al.
4,527,705 A 7/1985 Prades
4,564,117 A 1/1986 Herbert
4,576,297 A 3/1986 Larson
4,583,665 A 4/1986 Barriac
4,588,099 A 5/1986 Diez
4,625,875 A 12/1986 Carr et al.
4,637,519 A 1/1987 Dutt et al.
4,638,913 A 1/1987 Howe, Jr.
4,643,330 A 2/1987 Kennedy
4,648,520 A 3/1987 Stull
4,651,886 A 3/1987 Stull
4,662,529 A 5/1987 Moore
4,668,458 A 5/1987 Whitney
4,674,642 A 6/1987 Towns et al.
4,674,643 A 6/1987 Wilde et al.
4,682,463 A 7/1987 Foldesi
4,683,016 A 7/1987 Dutt et al.
4,694,970 A 9/1987 Hayes
4,704,180 A 11/1987 Marsella et al.
4,705,188 A 11/1987 Rahn
4,706,835 A 11/1987 Kreiseder
4,709,815 A 12/1987 Price et al.
4,721,215 A 1/1988 Bertaud
4,722,447 A 2/1988 Crisci
4,723,685 A 2/1988 Fillmore et al.
4,729,926 A 3/1988 Koteles et al.
4,730,748 A 3/1988 Bane
4,738,370 A 4/1988 Urmston et al.
4,747,500 A 5/1988 Gach et al.
4,747,502 A 5/1988 Luenser
4,754,890 A 7/1988 Ullman et al.
4,754,892 A 7/1988 Retief
4,757,914 A 7/1988 Roth et al.
4,764,403 A 8/1988 Ajmera
4,778,698 A 10/1988 Ou-Yang
4,779,750 A 10/1988 Armstrong
4,782,968 A 11/1988 Hayes
4,793,504 A 12/1988 Towns et al.
4,801,037 A 1/1989 Hayashida et al.
4,807,745 A 2/1989 Langley et al.
4,807,770 A 2/1989 Barriac
4,809,858 A 3/1989 Ochs
4,810,541 A 3/1989 Newman et al.
4,815,617 A 3/1989 Cullum
4,818,577 A 4/1989 Ou-Yang
4,842,951 A 6/1989 Yamada et al.
4,846,359 A 7/1989 Baird et al.
4,875,594 A 10/1989 Ochs
4,879,147 A 11/1989 Newman et al.
4,881,649 A 11/1989 Hsu et al.
4,892,911 A 1/1990 Genske
4,893,718 A 1/1990 Delespaul et al.
4,894,266 A 1/1990 Bauer et al.
4,896,783 A 1/1990 Leoncavallo et al.
4,935,273 A 6/1990 Ou-Yang
4,951,829 A 8/1990 Hsu
4,981,229 A 1/1991 Lanham
4,981,230 A 1/1991 Marshall et al.
4,991,731 A 2/1991 Osip et al.
4,997,097 A 3/1991 Krautkramer
5,002,811 A 3/1991 Bauer et al.
5,006,384 A 4/1991 Genske
5,007,546 A 4/1991 Rose et al.
5,009,323 A 4/1991 Montgomery et al.
5,009,324 A 4/1991 Ochs
5,011,719 A 4/1991 Gehrke et al.
5,012,946 A 5/1991 McCarthy
5,023,121 A 6/1991 Pockat et al.
5,031,787 A 7/1991 Ochs
5,058,755 A 10/1991 Hayes
5,061,532 A 10/1991 Yamada
5,069,355 A 12/1991 Matuszak
5,071,686 A 12/1991 Genske et al.
5,078,290 A 1/1992 Ochs
5,092,469 A 3/1992 Takata et al.
5,093,164 A 3/1992 Bauer et al.
5,110,642 A 5/1992 Genske
5,120,787 A 6/1992 Drasner
5,121,845 A 6/1992 Blanchard
5,135,125 A 8/1992 Andel et al.
5,151,317 A 9/1992 Bothe

(56) References Cited

U.S. PATENT DOCUMENTS

| | | | |
|---|---|---|---|
| 5,160,767 | A | 11/1992 | Genske et al. |
| 5,175,035 | A | 12/1992 | Pinsolle et al. |
| 5,176,271 | A | 1/1993 | Painchaud et al. |
| 5,178,293 | A | 1/1993 | Suzuki et al. |
| 5,197,618 | A | 3/1993 | Goth |
| 5,197,620 | A | 3/1993 | Gregory |
| 5,197,621 | A | 3/1993 | Bartl et al. |
| 5,246,126 | A | 9/1993 | Lewis, Jr. |
| 5,255,813 | A | 10/1993 | Berggren et al. |
| 5,258,191 | A | 11/1993 | Hayes |
| 5,259,522 | A | 11/1993 | Morton |
| 5,265,745 | A | 11/1993 | Pereyra et al. |
| 5,302,442 | A | 4/1994 | O'Brien et al. |
| 5,342,684 | A | 8/1994 | Carespodi |
| 5,346,082 | A | 9/1994 | Ochs et al. |
| 5,353,665 | A | 10/1994 | Heebner |
| 5,381,913 | A | 1/1995 | Peeters |
| 5,407,751 | A | 4/1995 | Genske et al. |
| 5,415,306 | A | 5/1995 | Luch et al. |
| 5,421,470 | A | 6/1995 | Dudzik |
| 5,433,992 | A | 7/1995 | Galda et al. |
| 5,447,792 | A | 9/1995 | Brandt et al. |
| 5,469,968 | A | 11/1995 | Matthews et al. |
| 5,492,757 | A | 2/1996 | Schuhmann et al. |
| 5,500,265 | A | 3/1996 | Ambroise et al. |
| 5,513,781 | A | 5/1996 | Ullrich et al. |
| 5,523,136 | A | 6/1996 | Fischer et al. |
| 5,533,622 | A | 7/1996 | Stockley, III et al. |
| 5,551,608 | A | 9/1996 | Moore et al. |
| 5,615,789 | A | 4/1997 | Finkelstein et al. |
| 5,626,929 | A | 5/1997 | Stevenson |
| 5,632,004 | A | 5/1997 | Bergstrom |
| 5,664,694 | A | 9/1997 | Bietzer et al. |
| 5,685,443 | A | 11/1997 | Taber et al. |
| 5,702,015 | A | 12/1997 | Giles et al. |
| 5,720,401 | A | 2/1998 | Moore |
| 5,723,507 | A | 3/1998 | Markovich et al. |
| 5,738,231 | A | 4/1998 | Montgomery |
| 5,756,178 | A | 5/1998 | Obadia |
| 5,773,136 | A | 6/1998 | Alder et al. |
| 5,785,195 | A | 7/1998 | Zwemer et al. |
| 5,788,101 | A | 8/1998 | King |
| 5,837,369 | A | 11/1998 | Grunberger et al. |
| 5,839,592 | A | 11/1998 | Hayes |
| 5,850,951 | A | 12/1998 | Hayes |
| 5,851,640 | A | 12/1998 | Schuhmann et al. |
| 5,860,544 | A | 1/1999 | Brucker |
| 5,862,928 | A | 1/1999 | Breuer et al. |
| 5,875,909 | A | 3/1999 | Guglielmini |
| 5,882,789 | A | 3/1999 | Jones et al. |
| 5,884,788 | A | 3/1999 | Wilde |
| 5,902,075 | A | 5/1999 | Krings |
| 5,915,577 | A | 6/1999 | Levine |
| 5,915,578 | A | 6/1999 | Burt |
| 5,925,430 | A | 7/1999 | Bayer et al. |
| 5,927,530 | A | 7/1999 | Moore |
| 5,929,128 | A | 7/1999 | Whetten et al. |
| 5,947,311 | A | 9/1999 | Gregory |
| 5,973,077 | A | 10/1999 | Kan et al. |
| 5,992,661 | A | 11/1999 | Zumbuhl |
| 5,997,968 | A | 12/1999 | Dries et al. |
| 6,006,930 | A | 12/1999 | Dreyer et al. |
| 6,044,994 | A | 4/2000 | Miller |
| 6,056,136 | A | 5/2000 | Taber et al. |
| 6,056,141 | A | 5/2000 | Navarini et al. |
| 6,068,933 | A | 5/2000 | Shepard et al. |
| 6,082,566 | A | 7/2000 | Yousif et al. |
| 6,082,568 | A | 7/2000 | Flanagan |
| 6,089,390 | A | 7/2000 | Druitt et al. |
| 6,105,800 | A | 8/2000 | Czesak |
| 6,119,422 | A | 9/2000 | Clear et al. |
| 6,119,883 | A | 9/2000 | Hock et al. |
| 6,123,212 | A | 9/2000 | Russell et al. |
| 6,152,316 | A | 11/2000 | Niese |
| 6,152,319 | A | 11/2000 | Kamachi et al. |
| 6,158,604 | A | 12/2000 | Larguia, Sr. et al. |
| 6,165,576 | A | 12/2000 | Freedman et al. |
| 6,179,139 | B1 | 1/2001 | Heilman |
| 6,202,871 | B1 | 3/2001 | Kelly |
| 6,206,871 | B1 | 3/2001 | Zanon et al. |
| 6,213,321 | B1 | 4/2001 | Zumbuhl |
| 6,220,466 | B1 | 4/2001 | Hayes et al. |
| 6,231,975 | B1 | 5/2001 | Kong et al. |
| 6,234,338 | B1 | 5/2001 | Searle |
| 6,235,822 | B1 | 5/2001 | Whetten et al. |
| 6,237,789 | B1 | 5/2001 | Zhu |
| 6,239,210 | B1 | 5/2001 | Kim et al. |
| 6,253,939 | B1 | 7/2001 | Wan et al. |
| 6,253,940 | B1 | 7/2001 | Graham et al. |
| 6,257,430 | B1 | 7/2001 | Rinnie et al. |
| 6,265,083 | B1 | 7/2001 | Tanizaki et al. |
| 6,276,543 | B1 | 8/2001 | German et al. |
| 6,277,478 | B1 | 8/2001 | Kurita et al. |
| 6,302,321 | B1 | 10/2001 | Reese et al. |
| 6,315,140 | B1 | 11/2001 | Nadel |
| 6,382,443 | B1 | 5/2002 | Gregory |
| 6,382,445 | B1 | 5/2002 | McCandless |
| 6,419,101 | B1 | 7/2002 | Hessel et al. |
| 6,477,823 | B1 | 11/2002 | Kitterman et al. |
| 6,488,165 | B1 | 12/2002 | Hidding |
| 6,502,710 | B1 | 1/2003 | Bosl et al. |
| 6,581,793 | B1 | 6/2003 | Racine et al. |
| 6,659,297 | B2 | 12/2003 | Gregory et al. |
| 6,848,590 | B2 | 2/2005 | Brozell et al. |
| 6,854,614 | B2 | 2/2005 | Sprick |
| 6,874,647 | B2 | 4/2005 | Bloom et al. |
| 6,893,672 | B2 | 5/2005 | Ingraham |
| 6,902,075 | B2 | 6/2005 | O'Brien et al. |
| 6,913,157 | B2 | 7/2005 | Oh |
| 6,915,918 | B2 | 7/2005 | Merrill |
| 6,948,630 | B2 | 9/2005 | Julian et al. |
| 7,004,340 | B2 | 2/2006 | Belden, Jr. |
| 7,021,478 | B1 | 4/2006 | Hock |
| 7,168,581 | B2 | 1/2007 | Robinson et al. |
| 7,175,039 | B2 | 2/2007 | German et al. |
| 7,217,454 | B2 | 5/2007 | Smelko et al. |
| 7,314,669 | B2 | 1/2008 | Galloway |
| 7,780,024 | B1 | 8/2010 | Marsella et al. |
| 1,060,369 | A1 | 4/2013 | Schwenck |
| 2001/0012868 | A1 | 8/2001 | Chen et al. |
| 2002/0027123 | A1 | 3/2002 | Druitt |
| 2002/0066713 | A1 | 6/2002 | Ma |
| 2002/0162818 | A1 | 11/2002 | Williams |
| 2003/0071007 | A1 | 4/2003 | Ma et al. |
| 2003/0098285 | A1 | 5/2003 | Gregory et al. |
| 2003/0116524 | A1 | 6/2003 | Robinson et al. |
| 2003/0150833 | A1 | 8/2003 | Shenkar |
| 2004/0055992 | A1 | 3/2004 | Robinson et al. |
| 2004/0173944 | A1 | 9/2004 | Mueller et al. |
| 2005/0003125 | A1 | 1/2005 | Barber et al. |
| 2005/0048233 | A1 | 3/2005 | Nomula |
| 2005/0077297 | A1 | 4/2005 | Marshburn et al. |
| 2005/0077298 | A1 | 4/2005 | Nomula |
| 2005/0211657 | A1 | 9/2005 | Mallet et al. |
| 2005/0284837 | A1 | 12/2005 | Taber et al. |
| 2007/0125785 | A1 | 6/2007 | Robinson et al. |
| 2007/0138125 | A1 | 6/2007 | Granger |
| 2007/0187352 | A1 | 8/2007 | Kras et al. |
| 2008/0083694 | A1 | 4/2008 | Ammann |
| 2008/0290060 | A1 | 11/2008 | Ammann |
| 2009/0026165 | A1 | 1/2009 | Ammann |

FOREIGN PATENT DOCUMENTS

| | | |
|---|---|---|
| DE | 4206244 | 9/1993 |
| EP | 0269920 | 6/1988 |
| EP | 275102 | 7/1988 |
| EP | 405365 | 1/1991 |
| EP | 0421821 | 4/1991 |
| EP | 589033 | 10/1993 |
| EP | 0589033 | 3/1998 |
| GB | 2034288 | 6/1980 |
| JP | 1308772 | 12/1989 |
| JP | 02205574 | 8/1990 |

(56) References Cited

FOREIGN PATENT DOCUMENTS

| | | |
|---|---|---|
| JP | 02219769 | 9/1990 |
| JP | 2000052982 | 2/2000 |
| JP | 2001261054 | 9/2001 |
| WO | WO-9009935 | 9/1990 |
| WO | WO-2006002922 | 1/2006 |
| WO | WO-2007042205 | 4/2007 |

CLOSURE WITH LIFTING MECHANISM

CROSS-REFERENCE TO PRIOR APPLICATION

This divisional application claims priority to, and benefit from, U.S. patent application Ser. No. 11/934,600, filed on Nov. 2, 2007, which is incorporated herein by reference.

BACKGROUND OF THE INVENTION

1. Field of the Invention

The present invention relates to a closure and particularly to a closure having a device for lifting the liner from the container opening.

2. Description of Related Art

Various closures have long been used to remove liners from sealing engagement with the opening of the container neck. Often these liners are comprised primarily of a metallic disk. These closures have a bead projecting the inner surface of the skirt to apply upward pressure to the metallic disc thereby breaking the cooperative engagement with the container. The rigidity of the metal forming the disk must be greater than the peel strength, otherwise the metallic disk will be subject to bending and unsightly deformation upon removal of the closure from the plastic container. Moreover, the bead's contact point moves radially outward relative to the flexing liner resulting in failure to remove such a semi flexible liner upon removal of the closure. The disclosed closure enables a semi flexible liner, as well as a substantially rigid liner, to be removed from the container neck.

DETAILED DESCRIPTION

Figure 1:
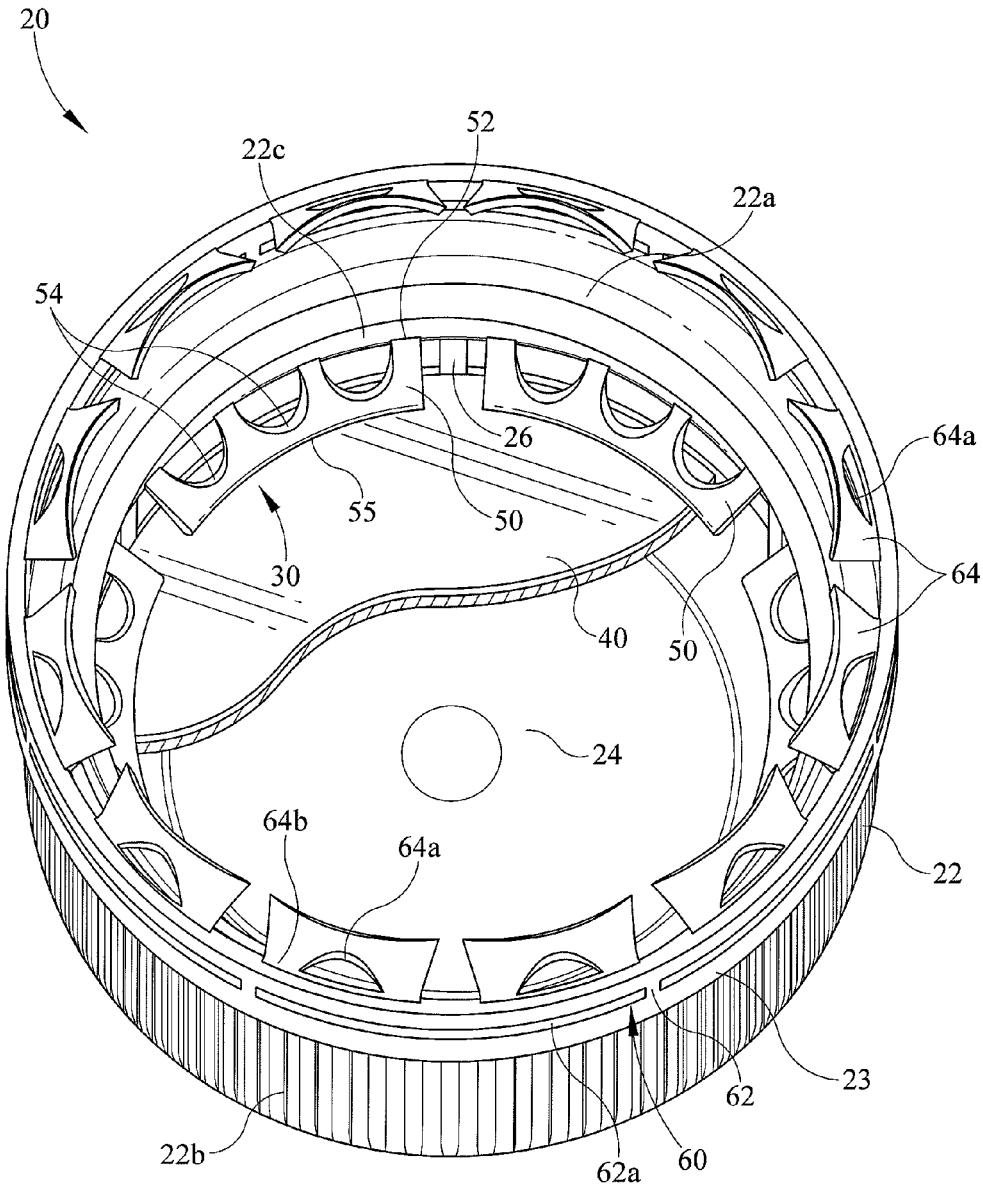
FIG. 1 shows a bottom perspective view of an embodiment of a closure illustrating the fingers in the upwardly position, with portions of the liner partially broken away.

A closure 20 including one embodiment of a lifting device 30 is shown in FIGS. 1-5, 9, and 10. Closure 20 is threadably connected to a container 1. FIGS. 2-5 depict container 1 having a neck finish 2 and an upper edge 4 of the neck finish defining an opening or flow communication path 6. Neck finish 2 further comprises at least one external thread 8, discontinuous or continuous, extending helically about the outer surface thereof and a neck finish bead 9.

Closure 20 is shown in FIGS. 1-5, 9, and 10, having a circular top wall 24. Depending from top wall 24 is an annular skirt 22 defining a cavity for receiving container neck finish 2. A lower portion of skirt 22 defines an opening of the cavity wherein a container neck finish 2 may be threadably disposed. Annular skirt 22 has an inner surface having at least one internal thread 22*a*, continuous as shown or discontinuous (not shown), helically extending there about, as seen in FIGS. 1-5. Extending vertically along an outer surface of closure 20 may be a plurality of knurlings or axial ribs 22*b*, or other similar texturing to enhance gripping and torque for application and removal of closure 20 from container 1. Depending from an inner surface of top wall 24 may be a liner or seal 40.

Closure 20 may be formed of a rigid or semi-rigid polymeric material such as polyethylene, polypropylene, or some other material commonly known to one of ordinary skill in the art for use in compression or injection molding. Moreover, closure 20 may be formed having a plurality of dimensions depending on the desired use of the closure and container associated therewith. It is to be understood that a variety of closures with varying size, shape, and construction such as a two piece, push and turn child resistant closure can be used, and still permit the use of the lifting fingers. It is also to be understood that the closure may also incorporate any child resistant mechanism or tamper-indication known to those skilled in the art.

Figure 2:
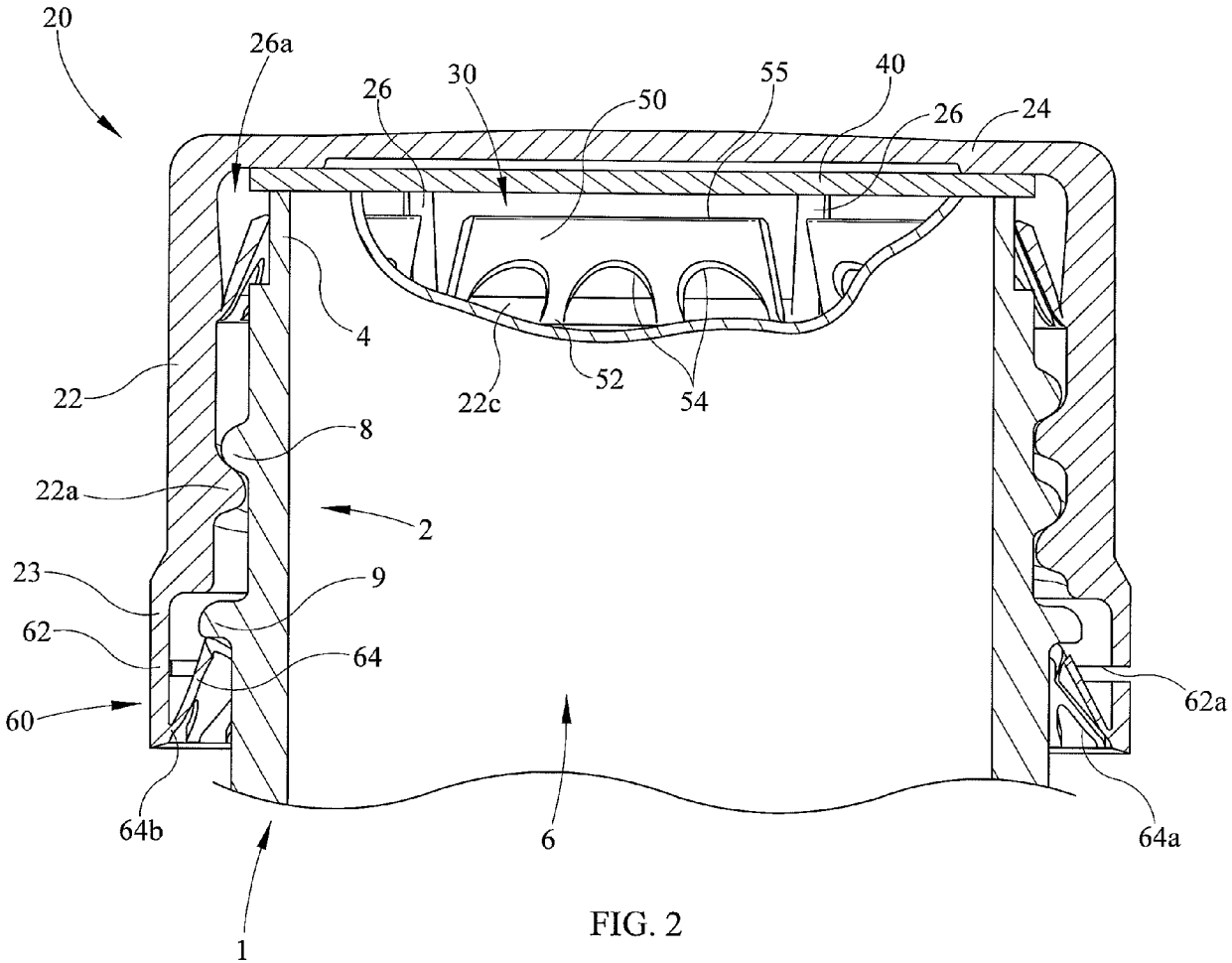
FIG. 2 shows a sectional view of the closure embodiment of FIG. 1 in a fully closed configuration upon a container neck, with portions of the container neck partially broken away.
Figure 3:
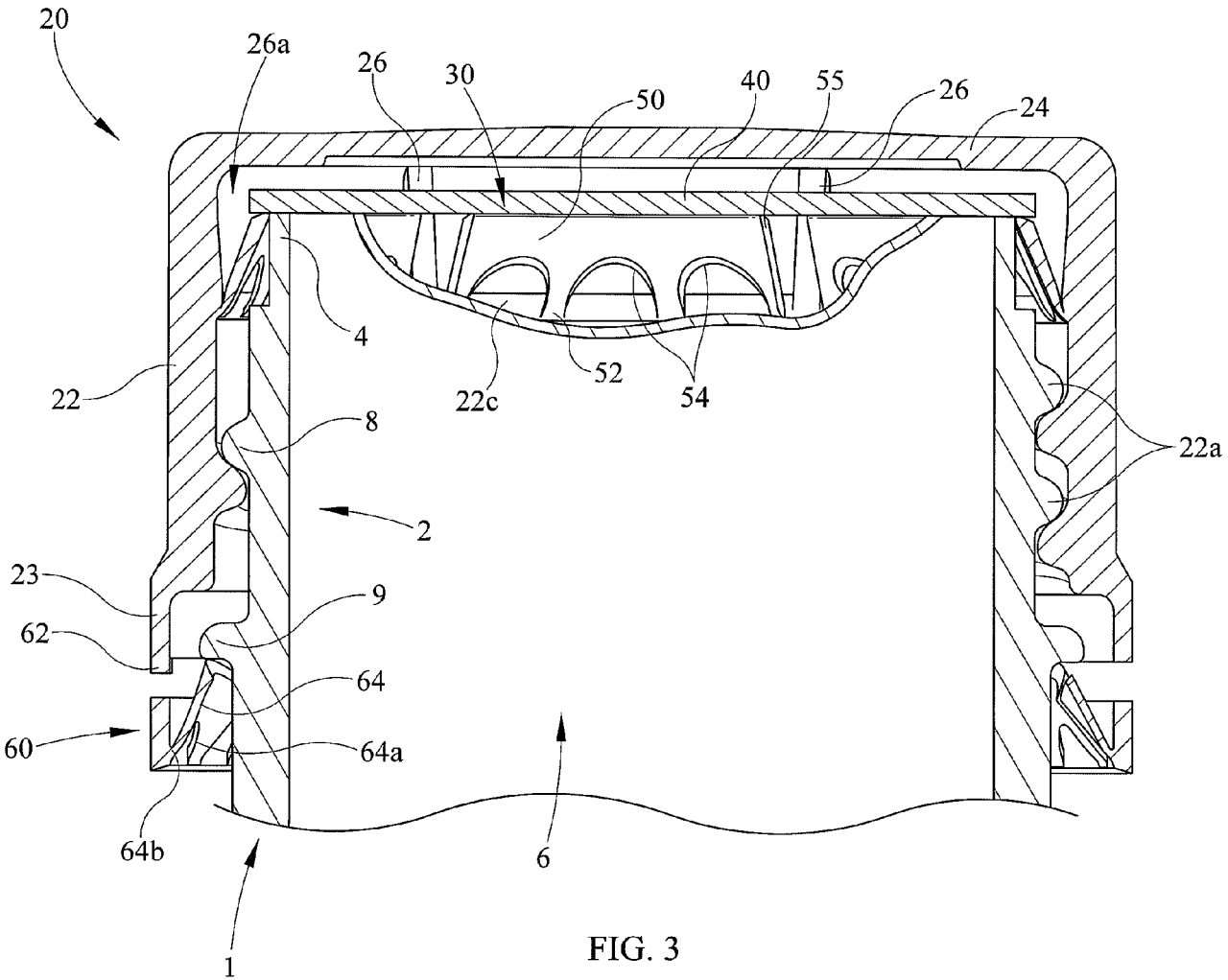
FIG. 3 shows a sectional view of the closure embodiment of FIG. 2 wherein the closure is progressively removed from the container neck illustrating the tamper-indicating feature is overcome and the fingers engaging the liner, with portions of the container neck partially broken away.
Figure 4:
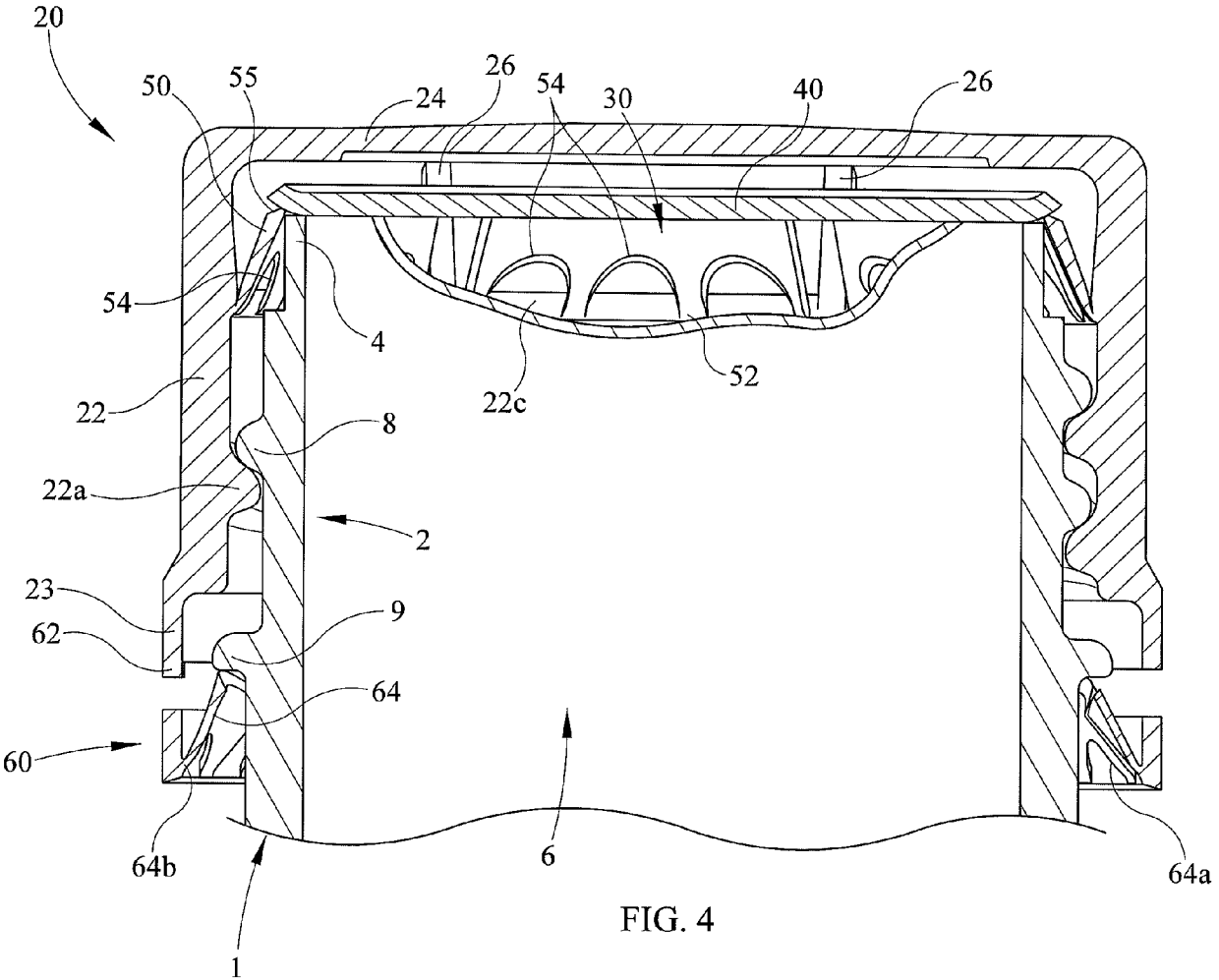
FIG. 4 shows a sectional view of the embodiment of FIG. 3 wherein the closure is progressively removed from the container neck illustrating the initial lifting of the liner from the container neck, with portions of the container neck partially broken away.
Figure 5:
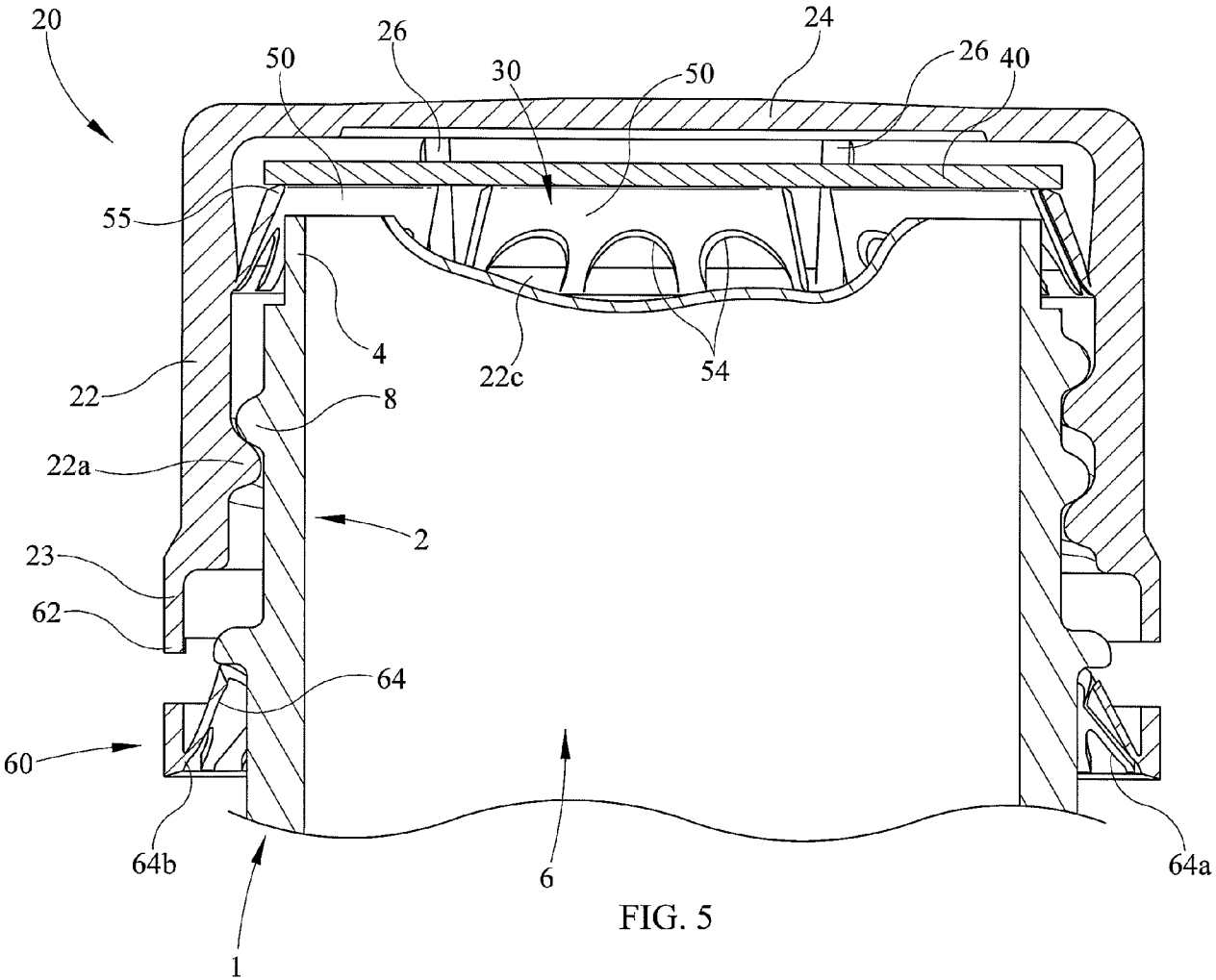
FIG. 5 shows a sectional view of the embodiment of FIG. 4 wherein the closure is progressively removed from the container neck illustrating the liner disengaged from the container neck, with portions of the container neck partially broken away.

As shown in FIGS. 1-6, 9, and 10, closure 20 has a lifting device 30 for removing liner 40 disposed over opening 6 of the container neck finish. Lifting device 30 projects from the inner surface of depending skirt 22. As depicted in FIG. 2-5, upon removal of closure 20 from engagement with container neck finish 2, the lifting device 30 will slide along the outer surface of the container neck finish and into engagement with the underside of liner 40. As shown in FIG. 3, when a tamper-indicating device 60 is utilized, the tamper-indicating device would be preferably at least partially or visibly overcome before any portion of the liner has been disengaged from the container neck finish. Tamper-indicating device 60 is activated by axial movement from the thread pitch and therefore occurs over a greater rotational arc and less torque as compared to rotation resisting ratchets. During removal of closure 20, the lifting device engages the liner along an annulus spaced from the liner edge and remains in contact along that annulus on the liner as the closure is radially turning upon removal. As shown in FIG. 4, during removal of closure 20 from container neck 2, lifting device 30 will continue to lift liner 40 at substantially the same annular position even when the liner cups or curves as it disengages from upper edge 4 of neck finish 2. As shown in FIG. 5, further rotation of closure 20 results in lifting device 30 removing liner 40, breaking the seal between the liner and the upper edge of container neck finish 2. After substantial separation of liner 40 from container 1, even if lifting device 30 slides relative to the liner 40 it will retain the liner within the closure. Closure 20 may then be reapplied and re-established a compressive seal between liner 40 and container 1 since the liner is retained in the closure by lifting device 30.

Figure 6:
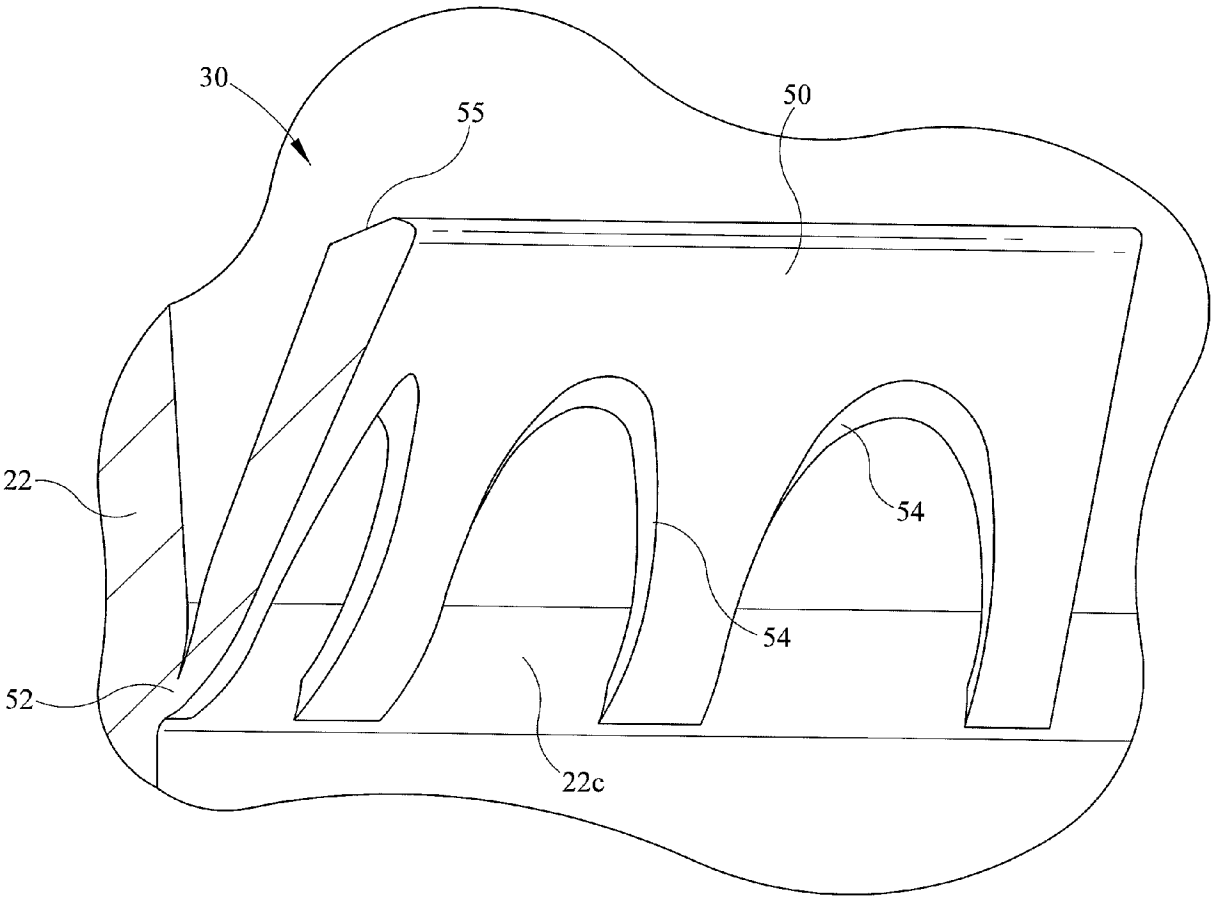
FIG. 6 shows an enlarged, perspective view of the finger of FIG. 1.
Figure 7:
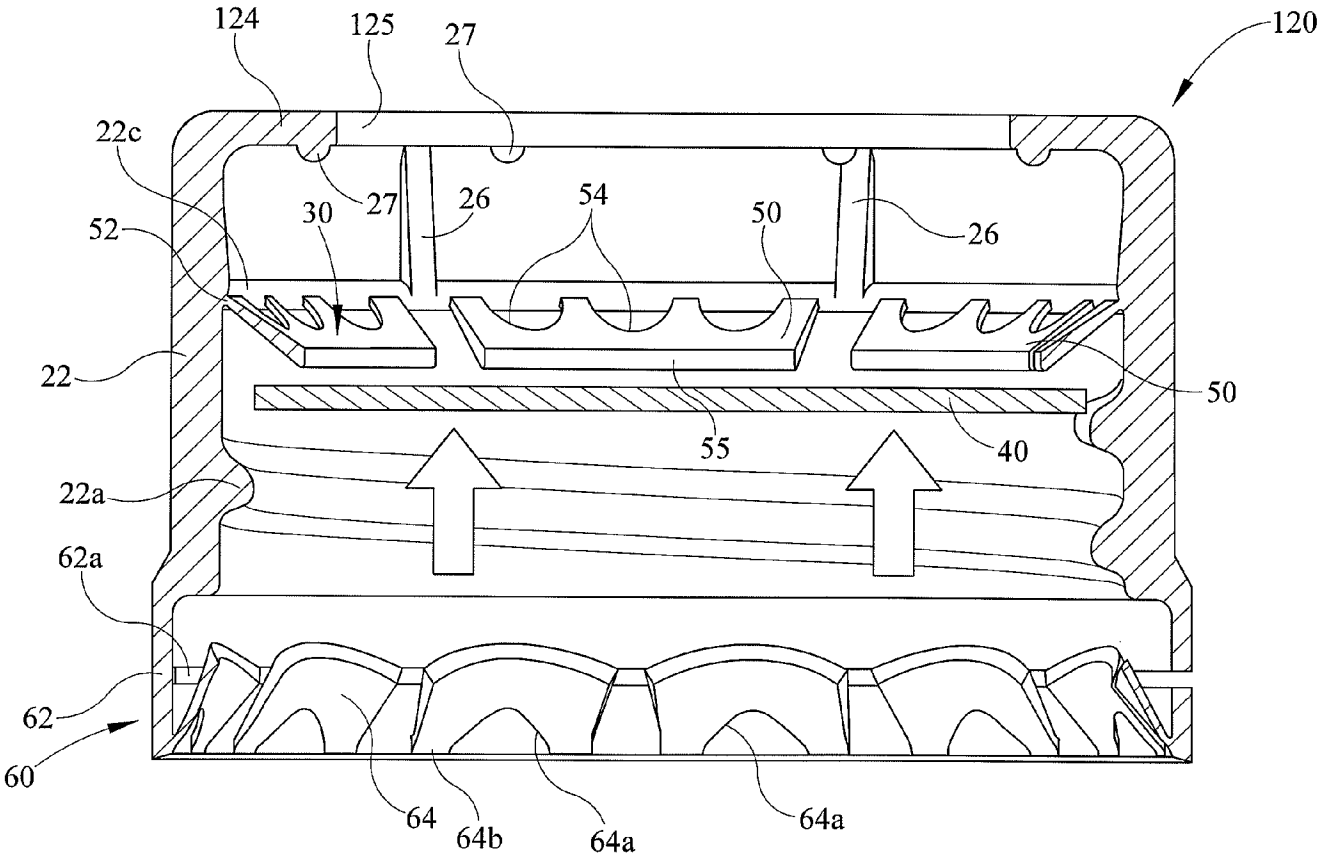
FIG. 7 shows a sectional view of an alternative embodiment of the closure of FIG. 1 illustrating the fingers in a downwardly position before insertion of the liner.
Figure 8:
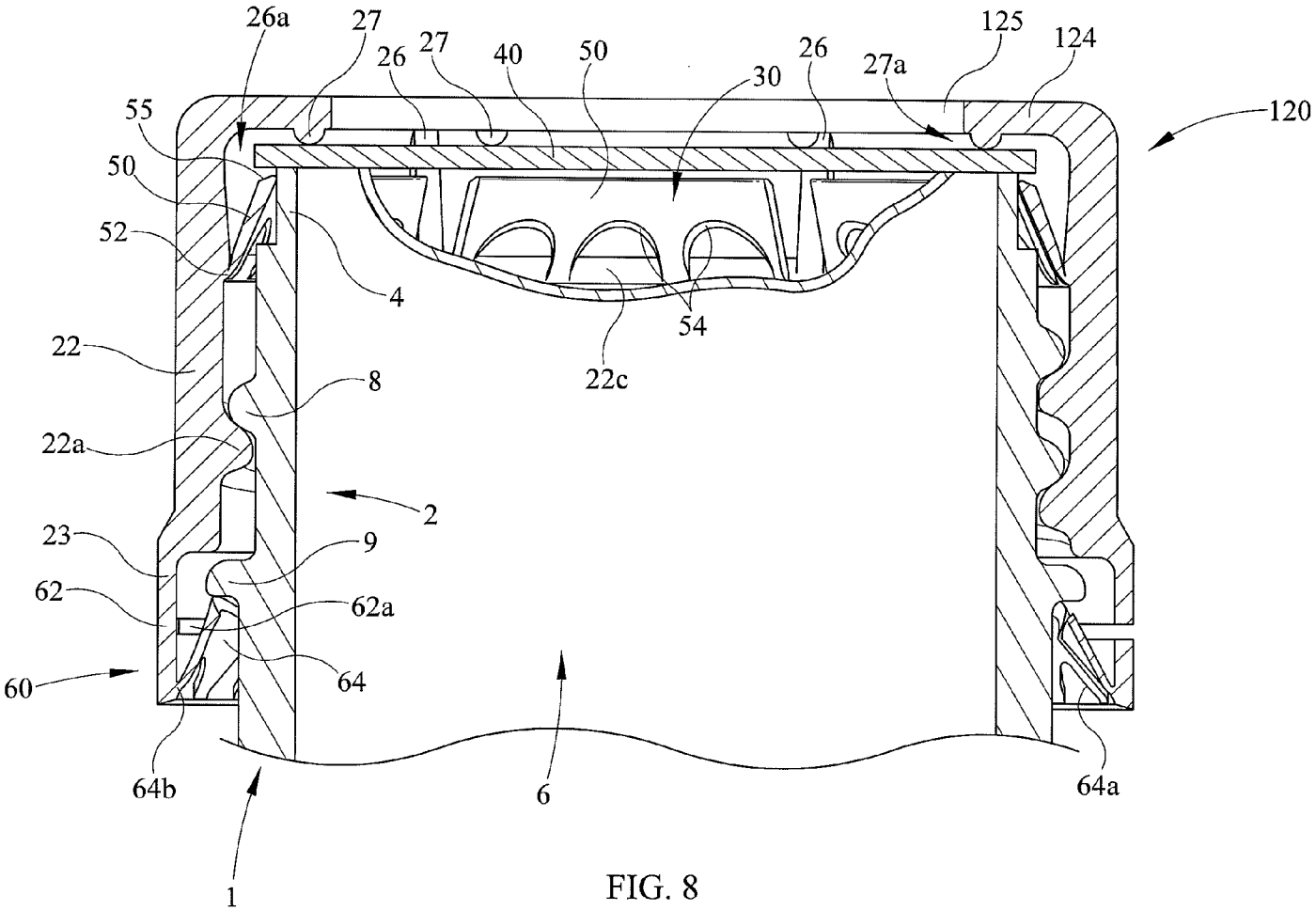
FIG. 8 shows a partial, sectional view of the embodiment of FIG. 7 upon insertion of the liner in a fully closed configuration upon the container neck, with portions of the container neck partially broken away.
Figure 9:
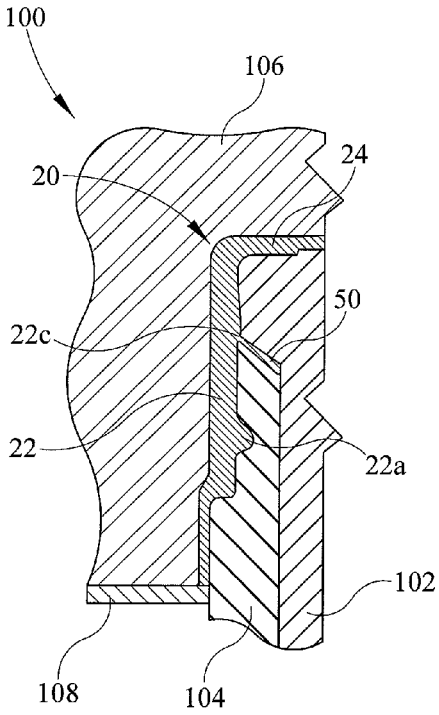
FIG. 9 shows a partial, sectional view of a mold cavity with the inner and outer lower mold core elements completely received within the mold cavity after the closure embodiment of FIG. 1, with the tamper-indicating band removed, has been formed therein.
Figure 10:
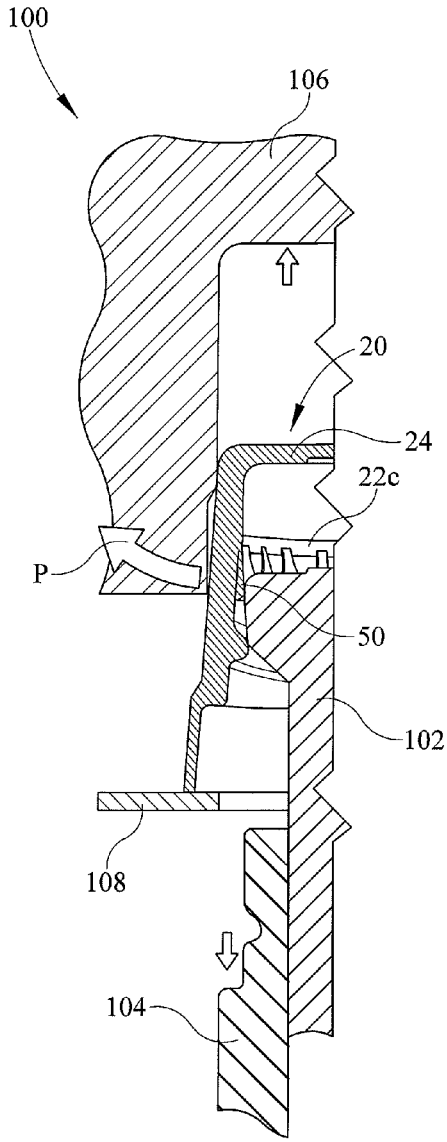
FIG. 10 shows a partial, sectional view of the mold cavity of FIG. 9 with the inner and outer lower core elements sequencing out of the mold cavity and closure, and the upper mold cavity being partially removed from the mold cavity.
Figure 14:
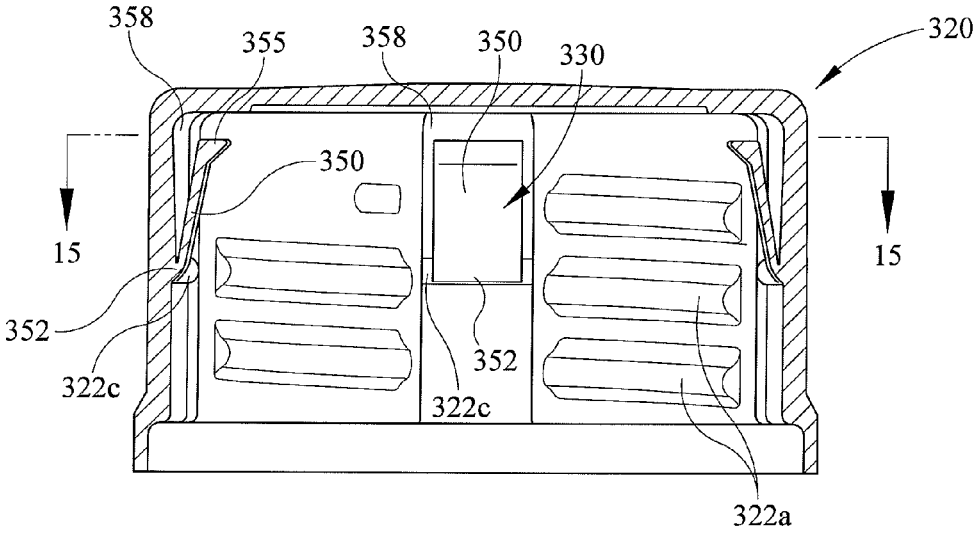
FIG. 14 shows a side, sectional view of another alternative embodiment of a closure.
Figure 15:
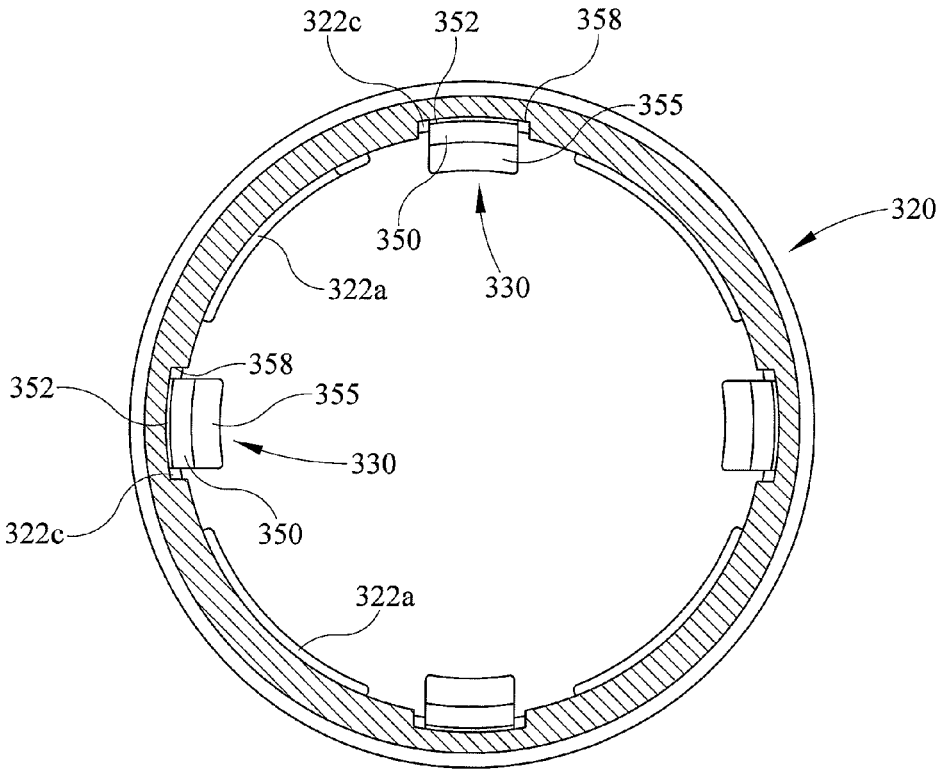
FIG. 15 shows a top, sectional view of the closure of FIG. 14 taken along line 15-15.

Referring now to FIGS. 1-10, one example of a lifting device 30 comprises a finger or plurality of fingers 50 projecting from the interior surface of depending skirt 22, creating either a discontinuous or a continuous (not shown) annular configuration about the depending skirt. More particularly as shown in FIG. 6, each finger 50 has a hinged or pivotal connection 52 with the interior surface of depending skirt 22 permitting rotation of the finger between an upwardly position and a downwardly position. Hinge connection 52 is shown in FIGS. 1-10 positioned above threads 22*a* of closure 20, however it is to be understood that hinge connection 52 may be positioned at various levels along the length of the depending skirt and still function to lift the liner. For example as shown in FIGS. 14 and 15, a hinge connection 352 may be located in an area within threads 322*a* of a closure 320. Finger 50 may be bimodal whereby the larger the length of hinge connection 52 will increase the tendency of the finger to rotate upward from the downwardly molded position and stay in the upwardly direction, as well as increase the strength of the finger to resist deformation, "tiring", or "pole-vaulting". This phenomenon referred to as "tiring" or "pole-vaulting" relates to a tendency of lifting devices to deform and slide under the liner edge, and results in incomplete detachment of the liner from the closure which is undesirable. As shown in FIGS. 1-6, hinge connection 52 may project from a circumferential bead or step 22*c* on the interior of the skirt facilitating the molding of the fingers in a downwardly direction (FIGS. 9 and 10). If a bead 22*c* is used, pressure caused from sequencing out the inner mold core elements (104 followed by 102) from the mold cavities is applied substantially to the bead instead of the finger or hinge connection. Pressure upon the finger or hinge connection may stretch or cause failure of the hinge. Bead 22*c* may be discontinuous or continuous. Each finger 50 as shown may include one or more fluid paths, drain holes, gaps, or apertures 54. Apertures 54 of each finger 50 alone or in combination with discontinuous fingers allows for closure 20 to be placed on container 1 while it undergoes pasteurization or hot sterilization. Each aperture 54 may be disposed adjacent hinge connection 52 allowing process bath fluid from the pasteurization or hot sterilization which may be trapped behind the fingers to escape, thereby inhibiting bacterial and fungal growth. However, such a design is not necessary to utilize the other inventive features of the present embodiments.

As shown in FIGS. 1-10, each finger 50 in cross section has a distal free end 55 which is thicker than hinge connection 52. Such a rigid finger 50 reduces pole-vaulting or substantial sliding of the finger relative to liner 40. Distal free end 55 of each finger 50 may have a substantially squared-off end to increase the surface contact with sealed liner 40 when closure 20 is removed from neck finish 2. It is to be understood that finger 50 may be provided in a variety of shapes, such as curved, wedged shaped, or tapered; in a variety of sizes such as differing lengths and cross sections; various quantities and orientations such as helical along the threads of the closure, and other differing elements of construction, and still be capable of projecting from within the closure to enable the lifting of the liner from engagement with the container neck. Embodiments of finger 50 may constructed to lift a variety of liners 40 with differing bond strength differing while still minimizing failure due to flexing or pole-vaulting. A strong bonded liner may cause a finger which is too flexible, as contrasted with the embodiments of the present invention, to fail by traversing past the liner (pole-vaulting or tiring) or by sliding radially relative to the liner, during removal of the closure. This may result in a failure to completely remove the seal from the container neck.

Prior to application of closure 20 on neck finish 2, liner 40 may be placed in the closure by lifting fingers 50 and then retained therein. Alternatively, liner 50 may be sealed over opening 6 on container 1 prior to application of closure 20. As shown in FIG. 7, when liner 40 is installed within a closure 120 and fingers 50 are molded in the downwardly position (FIGS. 9 and 10), the liner will be inserted through the opening in skirt 22 of the closure and axially moved to top wall 124, rotating the fingers in the upwardly position (FIG. 8). Subsequently, fingers 50 retain liner 40 until application with container 1. When threading closure 20 (or closure 120 shown in FIGS. 7 and 8) upon container neck 2, fingers 50 may flex upwardly when the fingers come into contact with the container neck. However, if liner 40 is sealed upon container neck 2 before application of closure 20, the fingers may be upwardly directed or downwardly directed prior to application. When fingers 50 are downwardly directed during application of closure 20 upon container neck 2, the fingers rotate upwardly into the lifting position because of contact with the liner or the container neck. When closure 20 is fully engaged with container neck 2, induction heating can be used to seal the liner upon the container neck, but other suitable methods of bonding the liner to the container may also be used. Liner 40 may be a metal disc suitable for bonding to container neck by induction heat sealing, if a thermally responsive adhesive is applied to the bottom surface of the liner in position to seal to the container wall around the container mouth. Other liners, such as plastic or composite liners of plastic and metal, may also be suitable. The liner may be semi flexible as well as substantially rigid. The liner may be of a composition to undergo retort and/or aseptic processes. Liner 40 may be comprised of any material or layers of material such as, for example, polyethylene terephalate (PET), polyethylene (PE), Nylon, polypropylene (PP), polyvinylchloride (PVC), styrene, ethylene-vinyl-acetate (EVA), ethylene-vinyl-alcohol (EVOH), Santoprene, Vinyl, foams of the preceding materials, paper, metallic material such as aluminum or steel, or any other material or combinations thereof or shape as long as the liner keeps a sufficient rigidity to allow for lifting device 30 to engage and break the seal between the liner and the container neck. By rigid it is meant as having sufficient stiffness to prevent fracture or deformation of the liner that would tend to cause malfunction when the closure and liner are removed from a container.

Closure 120, another embodiment of the present invention, as well as closure 20, may be used in various retort and/or aseptic applications. As shown in FIGS. 7 and 8, closure 120 has one or more apertures, fluid paths, or openings 125 in top wall 124. Each opening 125 permits process bath fluid to drain from within closure 120, thereby inhibiting bacterial and fungal growth. Forced air introduced into the closure during retort and/or aseptic applications can also penetrate within the closure as a result of the apertures in the top surface to remove bath fluid or naturally introduce air to remove entrapped moisture. As shown in FIGS. 1-5, 7, and 8, closures 20 and 120 may also include one or more centering structures or ribs 26 to maintain the liner 40 within closure 20, 120 in a centered position. Vertical ribs 26 may project from the inner surface of depending skirt 22. With liner 40 substantially centered by ribs 26, one or more gaps 26*a* are created between the inner surface of depending skirt 22 and the liner. As shown in FIGS. 7 and 8, one or more bumps 27 may project from top wall 124 vertically positioning liner 40 within closure 120. As shown in FIG. 8, when closure 120 is applied to container neck 2, bumps 27 provide compression upon liner 40 as well as providing a gap 27*a* between top wall 124 and the liner. Gaps 26*a* and 27*a* created respectively by ribs 26 and bumps 27 create, as described above, airflow and drainage for the retort and aseptic processes. However, such a design is not necessary to utilize the other inventive features of the present embodiments. Also, closure 20, 120 may have jumped threads (not shown) for additional drainage and airflow. Also, if liner 40 is inserted into closure 20 or 120 before application to container 1, the liner and closure combination may be completely sterilized before application to the container.

Figure 11:
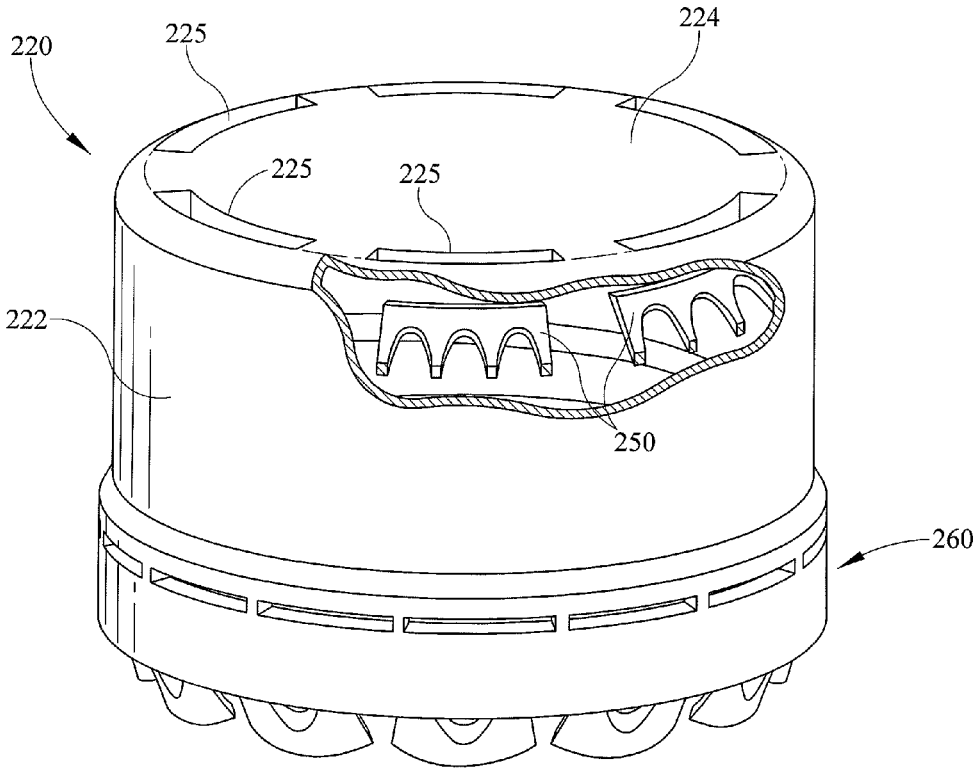
FIG. 11 shows a perspective view of an alternative embodiment of a closure with portions of the closure partially broken away.
Figure 13:
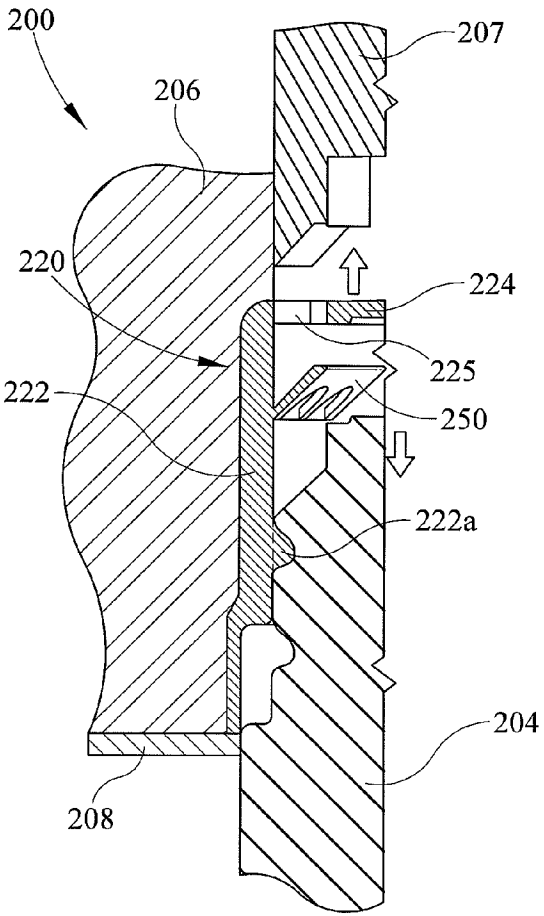
FIG. 13 shows a partial, sectional view of the mold cavity of FIG. 12 with the lower and upper core elements sequencing out of the closure.
Figure 12:
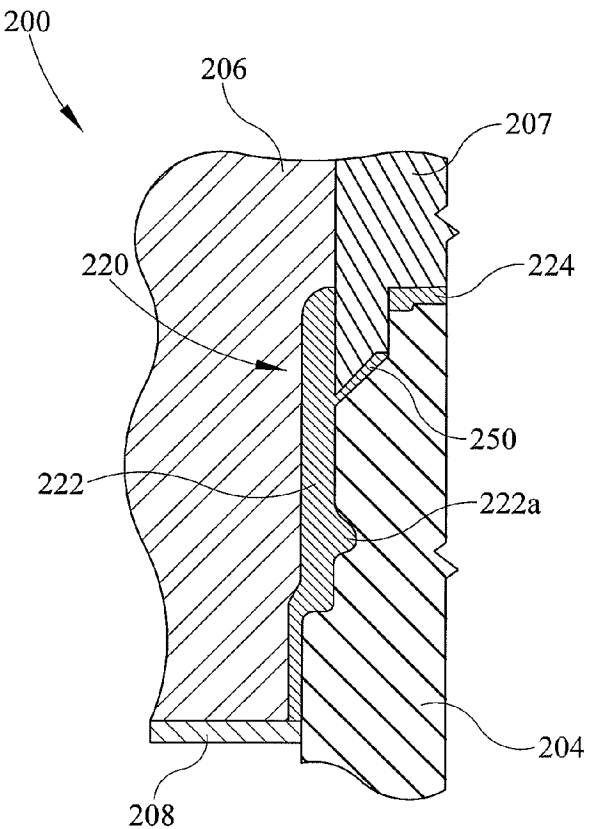
FIG. 12 shows a partial, sectional view of a mold cavity with a lower mold core elements and an upper mold core elements completely received within the mold cavity after the closure embodiment of FIG. 11, with the tamper-indicating band removed, has been formed therein.

The closure may be molded with fingers 250 in the upwardly direction (FIGS. 12 and 13) or alternatively with fingers 50 in the downwardly direction (FIGS. 9 and 10). As shown in FIGS. 9 and 10, fingers 50 are molded in the downwardly direction by sequencing the inner molding cavities of the die 100 out of the opening of closure 20. As shown in FIG. 10, when an outer core 104 of the inner mold cavity adjacent threads 22*a* of skirt 22 is sequenced out of closure 20, the downwardly molded fingers 50 are able to pivot P downwardly towards the distal end of the skirt upon extracting an inner core 102 of the inner mold cavity from the closure. A stripper ring 108 and outer mold cavity 106 are also sequenced for removal of closure 20. However as shown in FIGS. 11, 12, and 13, a closure 220 having apertures 225 in top wall 224 allows the molding of fingers 250 in the upwardly direction from skirt 222 above thread 222*a*. Aperture 225 permits a center core 207 of the outer mold cavity to project into top wall 224 of closure 220 assisting to form finger 250 in the upwardly direction, and then subsequently center core 207 of the outer mold cavity is extracted back through the aperture in the top wall as shown in FIG. 13. An outer core 206 of outer mold cavity, stripper plate 208, and inner mold core 204 are also sequenced to remove closure 220 from die 200. As shown in FIG. 11, top wall 224 may have multiple apertures 225, each coinciding with a finger 250. As described above, these apertures 225 also may serve as fluid paths out of the closure. Also, finger 250 of closure 220 may be molded without the bead or step as shown in FIGS. 11-13.

As shown in FIGS. 14 and 15, a closure 320 embodiment of the invention includes a lifting device 330. As described above, lifting device 330 comprises a plurality of fingers 350 having a hinge connection 352 located within the threads 322*a*. Each finger 350 is positioned vertically in a recess 358 between discontinuous threads 322*a*. During removal of closure 320 from the container neck, each recessed finger 350 has a distal end 355 able to lift the liner (not shown) and all engaging the liner around substantially the same annulus or annular position on the liner. Also, hinged finger 350 may project from a bead or step 322*c* much as previously discussed for other embodiments of the invention.

One benefit of the use of the embodiments of lifting fingers 50, 250, and 350 is that they make the closure in which they are used adaptable to fit on standardized container neck finishes 2. Lifting fingers 50, 250, and 350 permit a reduced "S" dimension within container neck finish 2. The "S" dimension is the vertical distance from the sealing surface, that is container neck upper edge 4, to the intersection of the neck finish wall and the top part of the first part of container thread 8 where full depth contour exists. A reduced "S" dimension reduces the overall height and amount of material used for both the closure and the container neck.

Referring now to FIGS. 1 and 2, a tamper-indicating or pilfer band 60 may be provided dependant from lower edge 23 of skirt 22. Band 60 may be frangibly or releasably connected to skirt 22 by at least one frangible web 62. Another tamper-indicating band 260 is shown in FIG. 11. The frangible web 62 may be formed by molding the web 62 during formation of closure 20 or by cutting a score line 62*a* in the tamper-indicating band 60 after closure 20 has been formed such as, for example, with a rotary cutter, a laser cutter, a high pressure water jet, an interrupted knife, or the like. Webs 62 may be disposed about a circumference defined by lower edge 23 of skirt 22. Alternatively, webs 62 may extend from the inner or outer surface of the annular closure skirt 22. Webs 62 may extend vertically downward or may be flared outward to inhibit breakage during application of closure 20 and to promote breakage of the frangible web 62 during removal from container neck finish 2. Should the frangible connection not break during removal of closure 20, severe damage would occur to tamper-indicating fingers 64 providing evidence of prior access.

As shown in FIG. 1, closure 20 is shown with an integral set of tamper-indicating fingers 64 in an unfolded configuration depending from tamper-indicating band 60. As shown in FIGS. 2, 3, 4, and 5, integral tamper-indicating fingers 64 of tamper-indicating band 60 are shown in the folded upward configuration resulting when closure 20 is in threaded engagement with container 1. Tamper-indicating fingers 64 may be folded in the upward position either prior to or during threaded application of closure 20 to container neck finish 2.

Because closure 20 may be used on containers which will undergo pasteurization or hot sterilization, the tamper-indicating fingers 64 as shown in FIGS. 1-5 may contain one or more fluid paths, drain holes, or gaps 64*a*. Each gap 64*a* may be disposed adjacent hinged connection or pivot 64*b* allowing process bath fluid from the pasteurization or hot sterilization which may be trapped behind the fingers to escape, thereby inhibiting bacterial and fungal growth. However, such a design is not necessary to utilize the other inventive features of the present embodiments.

It should be understood that a variety of other tamper-indicating devices, such as rotation resisting ratchets, may used with the embodiments of the invention, but are not necessary to utilize the other inventive features of the present embodiments. For example a tamper evident tab (not shown) may be provided which has to be torn off separately from the closure before the closure can be removed. Also, shrink wrap (not shown) made of a plastic that wraps tightly around the closure may be used. Shrink wrap may be removed by a user at a point of weakness or by a perforation in the plastic or by other means known in the art.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A method of separating a liner from a sealed position on a container neck comprising the steps of:

removing a closure having at least one internal hinged finger from engagement with a container neck, said at least one internal hinged finger having a hinged connection projecting from a step of an interior surface of a peripheral skirt of said closure, wherein said at least one hinged finger tapers toward said hinged connection adjacent said peripheral skirt of said closure, wherein a distal end of said at least one hinged finger is thicker in cross section than at a proximate end adjacent said hinged connection;

axially traveling said at least one hinged finger of said closure along an exterior surface of said container neck as said closure is removed;

engaging said distal end of said at least one hinged finger with an underside of a sealed liner along an annular position of said sealed liner, said annular position is at a first radius, wherein said first radius is adjacent said exterior surface of said container neck;

lifting said liner as said closure is removed by maintaining said engagement at said first radius of said annular position between said distal end of said at least one hinged finger and said liner underside substantially unchanged when lifting said liner up and away from an opening defined by said container neck during rotational removal of said closure from said container neck; thereby separating at least a portion of said liner from said container neck.

2. The method of claim 1 further comprising the step of maintaining said liner within said closure upon removal from said container neck.

3. The method of claim 1 further comprising the step of overcoming a tamper indicating device as said closure is removed.

4. The method of claim 1 wherein said at least one hinged finger is substantially rigid to resist deformation when lifting said liner.

5. The method of claim 1 further comprising a plurality of said hinged fingers.

6. The method of claim 1 wherein said at least one hinged finger includes an aperture, therethrough, adjacent said hinged connection.

7. The method of claim 1 wherein the step extends circumferentially on the skirt.

8. The method of claim 7 wherein the step is discontinuous as it extends circumferentially on the skirt.

9. A method of separating a liner from a sealed position on a container neck comprising the steps of:

removing a closure having a plurality of internal hinged fingers from engagement with a container neck, each said hinged finger having a hinged connection adjacent an interior surface of a peripheral skirt of said closure, wherein each said hinged finger is molded in a downward direction and tapers toward said hinged connection adjacent said peripheral skirt of said closure, wherein a distal end of each said hinged finger is thicker in cross section than at a proximate end adjacent said hinged connection;

axially traveling each said hinged finger of said closure along an exterior surface of said container neck as said closure is removed;

engaging each said hinged finger distal end with a sealed liner along an annular position on an underside of said sealed liner;

lifting said liner as said closure is removed by maintaining each said hinged finer distal end in substantial contact with said liner underside along said annual position; thereby separating at least a position of said liner from said container neck.

10. The method of claim 9 wherein at least one said hinged finger includes an aperture, therethrough, adjacent said hinged connection.

11. The method of claim 9 further comprising the step of overcoming a tamper indicating device as said closure is removed.

12. The method of claim 9 further comprising the step of maintaining said liner within said closure upon removal from said container neck.

13. The method of claim 9 wherein said hinged connection projects from a circumferential bead on said peripheral skirt interior surface.

14. The method of claim 9 further comprising the step of bonding said sealed liner to said container neck.

* * * * *